United States Patent [19]

Borodulin et al.

[11] Patent Number: 4,598,435

[45] Date of Patent: Jul. 8, 1986

[54] OPENER AND STOPPER FOR CRIMPED AND THREADED BOTTLE CAPS

[76] Inventors: German Borodulin, 2518 Clement St. #4, San Francisco, Calif. 94121; Alexander Shkolnik, 2031 Commonwealth Ave. #10, Brighton, Mass. 02135; Maxim Persidsky, 35 Temescal Ter., San Francisco, Calif. 94118

[21] Appl. No.: 757,456

[22] Filed: Jul. 22, 1985

[51] Int. Cl.[4] ..... B67B 7/44

[52] U.S. Cl. ..... 7/156; 215/322; 81/3.09

[58] Field of Search ..... 81/3.07, 3.09, 3.4; 215/322; 7/151, 152, 156

[56] References Cited

U.S. PATENT DOCUMENTS

| | | | |
|---|---|---|---|
| 758,235 | 4/1904 | Cady | 215/322 |
| 987,268 | 3/1911 | Thompson | 215/322 |
| 2,031,420 | 2/1936 | Lebherz | 81/3.09 |
| 3,389,622 | 6/1968 | Flugel | 81/3.09 |
| 3,736,817 | 6/1973 | Huff | 81/3.15 |

FOREIGN PATENT DOCUMENTS

| | | | |
|---|---|---|---|
| 1575063 | 9/1980 | United Kingdom | 7/152 |

*Primary Examiner*—Roscoe V. Parker
*Attorney, Agent, or Firm*—David Pressman

[57] ABSTRACT

A combined bottle opener and stopper (10) comprises a metal plate (12) with side edges (14) and (16) bent downward and inwardly. A rubber pad 26 is attached to the bottom face of the plate. Teeth (38*a*, 38*b*) are formed on the inner sides of the bent edges for engagement with serrations on the periphery of the cap to be removed. These teeth allow removal of threaded crown caps by unscrewing the caps in the position of engagement between their serrations and the teeth of the opener. Bent edges (14, 16) have different heights with the difference corresponding to the pitch of the thread on a threaded bottle neck. For temporary closing the bottle, i.e., with beer or carbonated water, the device is screwed onto the threaded bottle neck as a nut until the rubber pad is tightly pressed to the upper face of the bottle to hermetically close the latter. For closing bottles with nonthreaded bottle necks, the device is moved onto the bottle neck by guiding the convergent bent edges over the neck in a direction transverse to the bottle's axis until the device is fixed tightly on the bottle due to convergence of the bent edges with the rubber pad, thereby to seal the bottle's opening.

9 Claims, 8 Drawing Figures

OPENER AND STOPPER FOR CRIMPED AND THREADED BOTTLE CAPS

BACKGROUND

1. Field of the Invention

The present invention relates to a combined opener and temporary stopper for capped bottles, such as bottles for beer, juice, carbonated beverages, etc. Such bottles have caps which are held onto the bottle top either by threads which mate with threads on the bottle, or by sealing serrations which crimp the cap around a rim at the bottle's mouth.

2. Description of Prior Art

Known in the art (U.S. Pat. No. 758,235 to C. Cady, Apr. 26, 1904) is a combined opener and stopper (temporary sealer or closure) for bottles with crimp-on caps. The Cady opener and sealer comprises a metal plate having converging side edges which are bent downward and inwardly, a sealing pad made of a resilient material, such as rubber, attached to the inner surface of said plate between the bent edges, and an opening on the wider end of the plate.

The Cady device was used to seal open bottles by sliding the converging edges across the bottle's rim until the sealing pad was pressed and held onto the open mouth of the bottle. The opening in the Cady device was used to remove crimped-on bottle caps as follows: The rear edge of the opening was hooked under the bottom edge of the cap while the front edge of the opening rested on the top of the cap. Then the device was rotated up to pry off the cap.

Such a device was successfully used for many years until a new form of bottle cap appeared on the market, i.e., the threaded bottle cap. The threaded cap in use nowadays comes in two different types, short and tall. The short type, usually is used on beer bottles, has an incomplete or one full turn of thread on the inner surface of the cap with relatively coarse serrations (knurling) on its outside for better grasp and prevention of slippage during unscrewing. The tall type has a greater height and several complete turns of thread and serrations on its upper outside surface. Although both types of threaded caps are designed for removal by simple manual grasping and unscrewing, in practice removal requires substantial force. It is not unusual to see waiters in restaurants and cafes using conventional openers for removing short-height threaded caps from the bottles in the old pry-off fashion. However when this is done, the glass threads sometimes fracture, causing glass debris to fall into the beverage.

Another drawback of threaded bottles is that many conventional openers and stoppers cannot be used for temporarily closing and stoppering bottles because the threads interfere with the stopper. Also threaded caps of the tall type do not have lips on their lower end and fit tightly to the surface of the bottle neck and thus can't be opened with conventional openers.

OBJECTS AND ADVANTAGES OF THE PRESENT INVENTION

Accordingly, it is an object of the present invention to provide a combined bottle opener and stopper which is universal in use and can be employed for opening threaded and non-threaded caps with coarse serrations, fine serrations, inner incomplete turns, or several complete turns on the surface of the cap. Another object is to provide a combined bottle opener and closure which can be used for temporary hermetically closing bottles both with threaded and non-threaded necks. Still another object is to provide a combined bottle opener and stopper which has means for piercing metal cans containing juice, motor oil, etc. Further objects are to provide a combined bottle opener and closure which is universal in use, easy in operation, and simple to manufacture. Still further objects and advantages of the present invention will become apparent from a consideration of the ensuing description and drawings.

PREFERRED EMBODIMENT OF THE INVENTION

Figure 1:
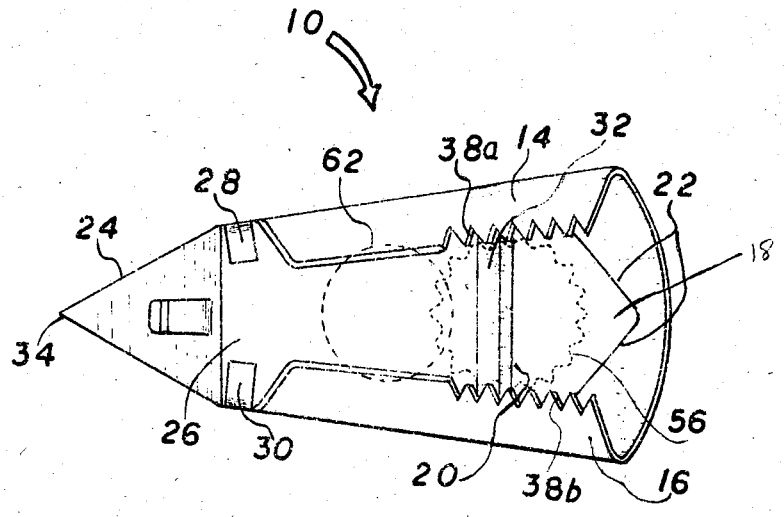
FIG. 1 is a bottom view of a combined bottle opener and stopper according to the invention.
Figure 2:
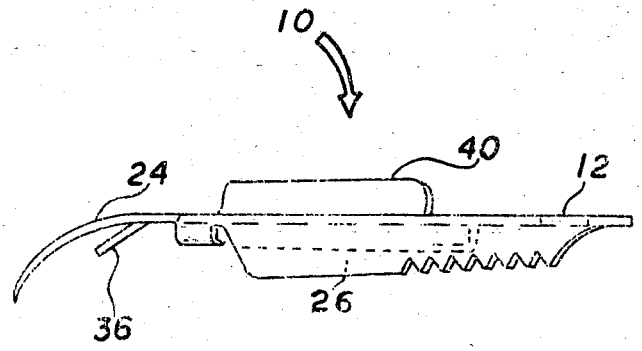
FIG. 2 is a side view of a device of FIG. 1.
Figure 3:
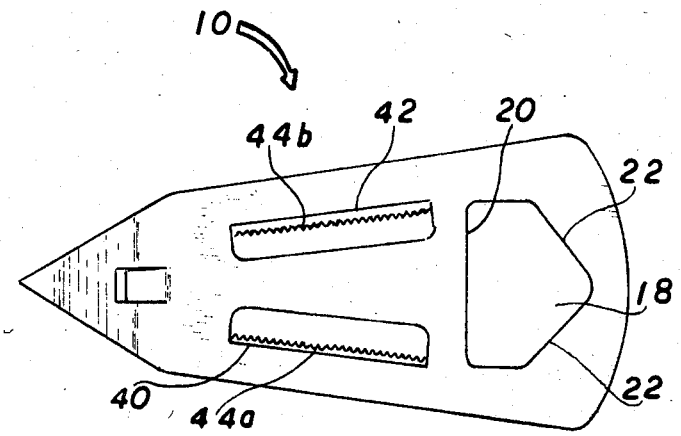
FIG. 3 is a plan view of the device of FIG. 1.
Figure 4:
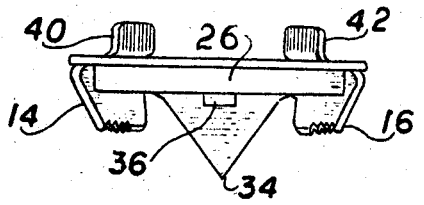
FIG. 4 is a cross-sectional view along line III—III in FIG. 3.
Figure 5:
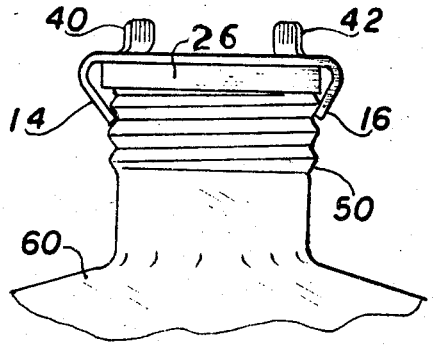
FIG. 5 is a side view illustrating the opener/stopper on a bottle with a threaded neck.

A combined bottle opener and stopper or temporary closure made according to one embodiment of the invention is shown in FIGS. 1 to 6 and is designated in general by reference numeral 10. FIG. 1 is a bottom view of the opener/stopper. The opener/stopper comprises a metal plate 12 having a converging shape and side edges bent downward and inwardly (FIG. 4). An opening 18, the shape of which is shown in FIG. 3, is formed, e.g., by stamping, on the wide portion of plate 12. The width of this opening must be slightly wider than the diameter of the bottle cap and its depth must be sufficient to allow a rear edge 20 of the opening to be inserted beneath the lip of the cap, with a front edge 22 of the opening resting on the top of the cap. This affords a fulcrum when a rear end 24 of plate 12 is lifted to pry off the cap.

A resilient pad 26 of rubber or similar material is positioned between bent edges 14 and 16 on the back face of plate 12. This resilient pad is fixed in place by means of bent portions 28 and 30 of plate 12 on its rear or narrow side and by bent portion 32 which, when bent inward, defines edge 20 of opening 18. Thus the rubber pad is fixed by bent portions 28, 30, and 32.

Rear or narrow end 24 of the opener/stopper has a point 34 for piercing metal cans which contain juice or motor oil. In a conventional manner, the opener/stopper has a lip 36 stamped out and bent downward from the plane of plate 12. This lip is used as a fulcrum point for piercing an opening in the can.

Edges 14 and 16 have teeth **38*a* and 38*b* on their inner sides. As shown in FIG. 1, these teeth correspond to the serrations formed around threaded cap 16** so that they can mate with these serrations when the opener/stopper is placed onto the cap from above.

For unscrewing threaded caps having several complete turns and fine serrations on their upper peripheral edge, the opener/stopper has edges 40 and 42 stamped upward from the metal of plate 12. As shown in a plan view of the device (FIG. 3), edges 40 and 42 converge toward the narrow end of the device. Their inner surfaces have teeth or serrations 44*a* and 44*b* which are used on corresponding caps in the same manner as teeth 38*a* and 38*b* on edges 14 and 16.

According to another embodiment of the invention, instead of edges 40 and 42, protrusions 46*a*, 46*b* and 46*c* (FIG. 7) can be used. These protrusions are arranged on a circle whose diameter is the same as the outer diameter of the cap. Protrusions 46*a*, 46*b*, and 46*c* have teeth or serrations 48*a*, 48*b*, and 48*c* which are intended to mate with corresponding serrations on the outside of the bottle cap.

An important feature of the invention is that lower edges 14 and 16 have slightly different heights so that the height of left edge 14 (FIGS. 4 and 5) exceeds the height of the right edge 16 by a pitch of thread 50 on the bottle's neck.

OPERATION OF THE DEVICE OF THE PRESENT INVENTION

The device of the present invention operates in the following manner:

When one desires to open a bottle with a non-threaded cap 52 (FIG. 8), he or she will use the opener/-stopper in a conventional manner, i.e., device 10 is placed in a position in which rear edge 20 of opening 18 is beneath lip 54 of cap 52 with front edge 22 of the opening resting on top of the cap. This provides a fulcrum so that when the rear end of plate 12 is lifted, cap 52 will be pried off.

Figure 8:
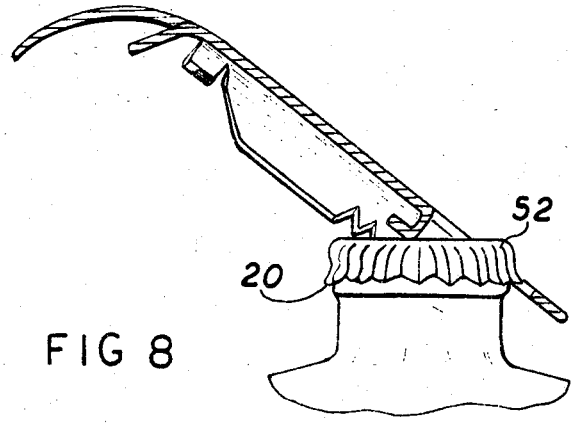
FIG. 8 is a view illustrating the position of the combined opener/stopper during opening a bottle with a non-threaded cap.

When one desires to remove a threaded cap of the type shown in FIG. 8, opener/stopper 10 is turned into position with edges 14 and 16 facing the cap and the opener/stopper is placed onto cap 56 (shown by broken lines in FIG. 1) so that teeth 38*a* and 38*b* mate with or grasp serrations or teeth on the periphery of the cap. The cap is then removed by unscrewing opener/stopper 10 in the counterclockwise direction.

Figure 6:
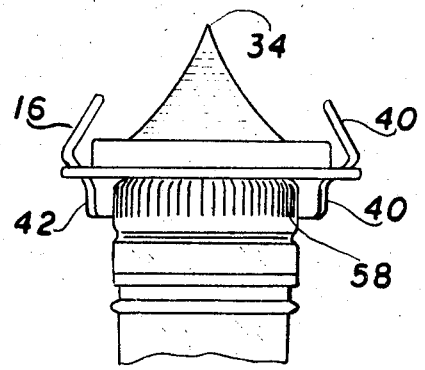
FIG. 6 is a side view illustrating the opener/stopper in position for opening bottles with threaded caps having fine serrations on their upper peripheral edge.
Figure 7:
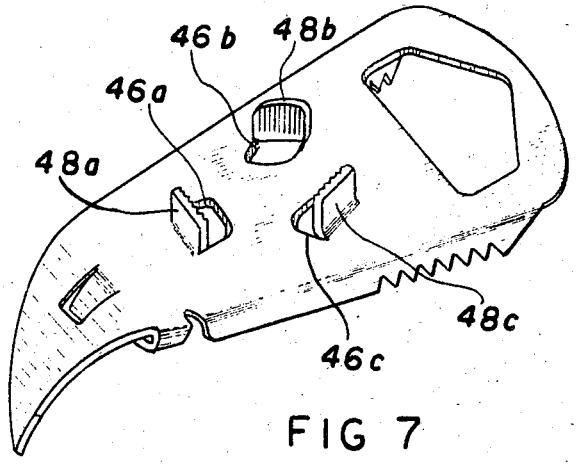
FIG. 7 is a perspective view illustrating another modification of the device of the opener/stopper.

For removing threaded caps 58 of the type shown in FIG. 6, opener/stopper 10 is placed into the position shown in FIG. 6 where cap 58 is jammed between converging edges 40 and 42 (or between projections 46*a*, 46*b*, and 46*c* in the embodiment of FIG. 7). Here teeth or serrations 44*a* and 44*b* on these edges will engage or mate with those of cap 58 (or teeth 48*a*, 48*b* and 48*c* on projections 46*a*, 46*b*, and 46*c*, respectively). Cap 58 can then be removed by unscrewing the opener/stopper in counterclockwise direction.

When one desires to pierce a metal can, e.g., with motor oil, piercing point 34 and lip 36 are used in a known manner which needs neither detailed description nor additional illustration.

For temporarily closing or stoppering a threaded bottle 60 (FIG. 5), e.g., with beer or carbonated beverage, the bottle's neck is inserted into the space between edges 14 and 16 and rubber packing 26 until lower ends 14*a* and 16*a* of bent edges 14 and 16 contact the space between adjacent turns or threads 50 of the bottle neck. Then the opener/stopper is turned in a clockwise direction (as with a conventional nut) with ends 14*a* and 16*a* acting as an internal thread of the nut until rubber packing 26 comes into tight sealing contact with the upper surface of the bottle neck, thereby hermetically sealing the bottle. For opening the bottle, opener/stopper 10 is simply unscrewed in the opposite (counterclockwise) direction.

For temporarily closing non-threaded bottles, bent edges 14 and 16 are used as guides which slide over the upper edges of the bottle's neck until the upper face of the bottle appears to be tightly pressed to rubber packing 26. Then opener/stopper 10 will be fixed onto the bottle due to the convergence of edges 14 and 16. The position of the bottle's neck relative to opener/stopper 10 in this case is shown by broken line 62 in FIG. 1. Teeth 38*a* and 38*b* do not interfere with insertion of the bottle's neck into the space between edges 14 and 16 since the distance between these teeth exceeds the diameter of the bottle's neck.

Opener/stopper 10 is simple to manufacture since in mass production it can be stamped from one metal sheet blank or a metal band on a press line.

The reader will note that the opener/stopper is universal and easy to use, simple to manufacture, and allows opening and closing of bottles both with threaded and non-threaded caps. It can remove caps of various types and can be used also for piercing metal cans with juice, machine oil, etc.

We have described the invention in the form of a preferred embodiment. However, those skilled in the art will easily envisage many other modifications and applications. For example, instead of piercing tip 34, a screwdriver tip can be formed on the narrow end of the device. More than three projections 46*a*, 46*b* and 46*c* can be formed on the top surface. The device can be produced by casting instead of stamping. It may have a handle or combined with any other means for any specific purpose. Therefore the scope of the invention should be determined, not by the examples given, but by the appended claims and their legal equivalents.

We claim:

1. A combined bottle opener and stopper for bottle necks of either the type which have a rim for mating with a crimp-on cap or which have male threads with a predetermined pitch for threaded mating with a cap having female threads, comprising:

a plate having upper and lower major surfaces, said plate having converging sides which extend down from said plate for grasping the outer periphery of a bottle cap and also for engaging a rim on a neck of said bottle, resilient means between said sides on the lower major surface of said plate for hermetically closing the opening of said bottle after said cap is removed, said converging sides having edges which are located at different distances from said lower major surface of said plate, the difference in distances of said edges from said lower major surface corresponding to said predetermined pitch of said male threads on said bottle neck, said sides and edges shaped so as to be able to engage the male threads of a threaded bottle neck so that said opener and stopper can be used to seal the neck of a threaded bottle.

2. The invention of claim 1 wherein said sides of said plate comprisses integral portions which are bent downwardly and inwardly toward each other so that they can be guided along the neck of said bottle in a direction transverse to the axis of said bottle.

3. The invention of claim 1 wherein said plate includes an opening for grasping and removing said crimp-on caps.

4. The invention of claim 1 wherein said plate has a converging configuration in its plan view.

5. The invention of claim 4 wherein a narrow end of said plate has a point for piercing the tops of cans.

6. The invention of claim 1 wherein said edges of said sides of said plate each have a series of teeth thereon.

7. A combined bottle opener and stopper for bottle necks of either the type which have a rim for mating with a crimp-on cap or male threads which have a predetermined pitch for threaded mating with a cap having female threads, comprising:

a plate being elongated, having upper and lower major surfaces, and a convergent configuration, said plate having a substantially triangular opening at a widened end thereof, the width of said opening in a direction perpendicular to the direction of elongation of said plate exceeding the diameter of either of said bottle caps and the depth of said opening in the direction of elongation of said plate beig sufficient for one edge of said opening to rest on the top of said cap and the opposite edge to fit under an edge of said cap, said plate having converging sides which extend integrally down and in from said plate for grasping the outer periphery of a bottle cap and also for engaging a rim on a neck of said bottle, a resilient pad attached to said lower major surface of said plate between said sides for hermetically closing the opening of said bottle after said cap is removed, said pad extending from one edge of said opening to the narrow end of said plate, said converging sides having edges which are located at different distances from said lower major surface of said plate, the difference in distances of said edges from said lower major surface corresponding to said predetermined pitch of said male threads of said bottle neck, said sides and edges shaped so as to be able to engage the male threads of a threaded bottle neck so that said opener and stopper can be used to seal the neck of a threaded bottle.

8. The invention of claim 7 wherein the narrow end of said plate has a point for piercing the tops of cans.

9. The invention of claim 7 wherein said edges of said sides of said plate each have a series of teeth thereon.

* * * * *